United States Patent [19]

Gamble

[11] 4,146,214

[45] Mar. 27, 1979

[54] PIPE-GRIPPING VISE ACCESSORY

[76] Inventor: Dansby L. Gamble, 11542 S. Lafayette, Chicago, Ill. 60628

[21] Appl. No.: 897,555

[22] Filed: Apr. 18, 1978

[51] Int. Cl.[2] ..... B25B 1/24

[52] U.S. Cl. ..... 269/272

[58] Field of Search ..... 269/321 N, 276, 272

[56] References Cited

U.S. PATENT DOCUMENTS

| | | | |
|---|---|---|---|
| 854,145 | 5/1907 | Broadbooks | 269/272 |
| 2,606,470 | 8/1952 | Kinney | 269/276 |
| 3,675,916 | 7/1972 | Kartasuk et al. | 269/321 N |

*Primary Examiner*—Robert C. Watson

*Attorney, Agent, or Firm*—Daniel Jay Tick

[57] ABSTRACT

A pipe-gripping vise accessory has a first jaw with a fastening device for removably affixing it to a first face of a first clamping member of a vise. The first jaw has a back in juxtaposition with the first face of the first clamping member when affixed thereto and a front spaced from the back and formed in a plurality of stepped teeth following a semicylindrical pattern. A second jaw has a fastening device for removably affixing it to a second face of a second clamping member of the vise. The second jaw has a back in juxtaposition with the second face of the second clamping member when affixed thereto and a front spaced from the back and formed in a plurality of teeth following a semicylindrical pattern.

1 Claim, 5 Drawing Figures

PIPE-GRIPPING VISE ACCESSORY

BACKGROUND OF THE INVENTION

The present invention relates to a pipe-gripping vise accessory. More particularly, the invention relates to a pipe-gripping vise accessory having first and second clamping members mounted for movement toward and away from each other, the first and second clamping members having first and second faces, respectively, facing each other.

Pipe-gripping vise accessories are disclosed in the following United States patents. U.S. Pat. No. 1,275,336, issued Aug. 13, 1918 to Weatherill, U.S. Pat. No. 1,397,409, issued Nov. 15, 1921 to Duwelius, U.S. Pat. No. 2,127,008, issued Aug. 16, 1938 to Petersen, U.S. Pat. No. 2,174,947, issued Oct. 3, 1939 to Ramsey, U.S. Pat. No. 2,606,470, issued Aug. 12, 1952 to Kinney and U.S. Pat. No. 3,833,210, issued Sept. 3, 1974 to Kotter.

Objects of the invention are to provide a pipe-gripping vise accessory of simple structure, which is inexpensive in manufacture, installed with facility, convenience and great rapidity on a vise, removed with facility, convenience and great rapidity from a vise, and functions efficiently, effectively and reliably to grip a pipe, or similar object, securely between the clamping members of the vise without slippage of such pipe and without damage thereto.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
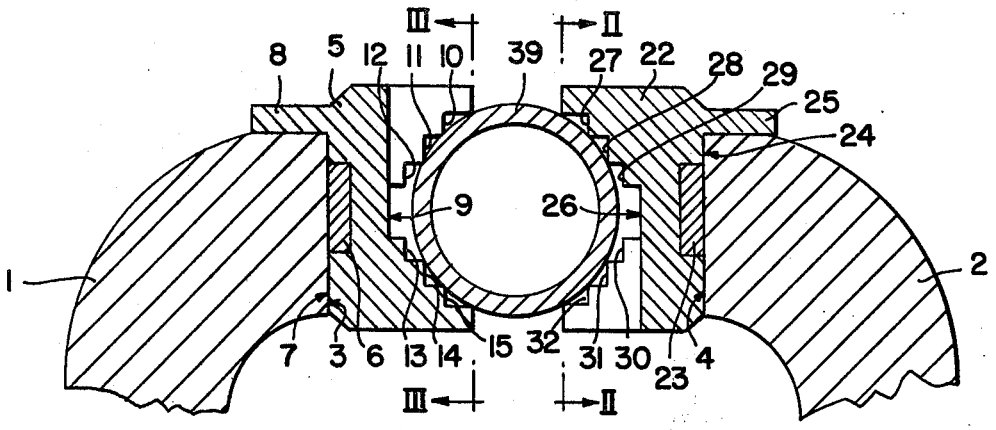
FIG. 1 is a cross-sectional view of an embodiment of the pipe-gripping vise accessory of the invention, as mounted on a vise.

The pipe-gripping vise accessory of the invention is for a vise having first and second clamping members 1 and 2, respectively, shown in FIG. 1. The first and second clamping members 1 and 2 are mounted for movement toward and away from each other in the usual manner of known vises. The first clamping member 1 has a first face 3 and the second clamping member has a second face 4 facing each other, as shown in FIG. 1.

The pipe-gripping vise accessory of the invention comprises a first jaw device 5 having a fastening device for removably affixing it to the first face 3 of the vise, as shown in FIG. 1. The fastening device of the first jaw device consists of a permanent magnet 6 embedded in the back 7 of said first jaw device, and a guide projection 8 which fits on the top of the first clamping member 1 when said first jaw device is in position thereon (FIG. 1). The back 7 of the first jaw device 5 is in juxtaposition with the first face 3 of the vise when said first jaw device is affixed to the first clamping member 1 of said vise. The first jaw device has a front 9, shown in detail in FIG. 3, and indicated in FIG. 1, spaced from the back 7 and formed in a plurality of stepped teeth 10, 11, 12, 13, 14 and 15 following a substantially semicylindrical pattern. In other words, the teeth 10 to 15 are formed in the inner surface of a semicylinder.

Figure 3:
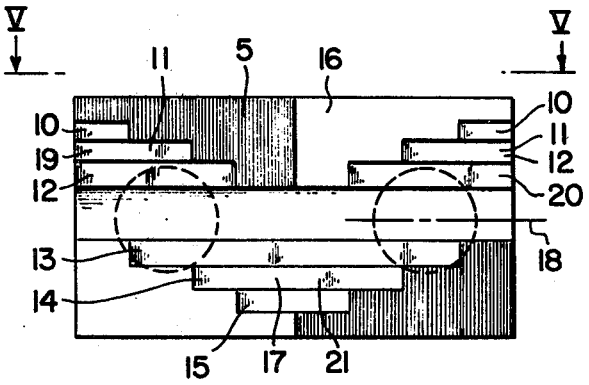
FIG. 3 is a view, taken along the lines III—III, of FIG. 1.
Figure 5:
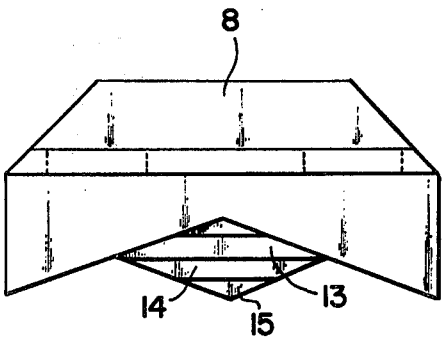
FIG. 5 is a view, taken along the lines V—V, of FIG. 3.

The front 9 of the first jaw device 5 is divided into first and second halves 16 and 17 by a central horizontal plane 18, as shown in FIG. 3. The teeth 10, 11 and 12 of the first half 16 of the first jaw device 5 are formed in the end parts 19 and 20 thereof, as shown in FIG. 3, and the teeth 13, 14 and 15 of the second half 17 are formed in the central part 21 thereof, as shown in FIGS. 3 and 5.

The pipe-gripping vise accessory of the invention further comprises a second jaw device 22 having a fastening device for removably affixing it to the second face 4 of the vise, as shown in FIG. 1. The fastening device of the second jaw device consists of a permanent magnet 23 embedded in the back 24 of said second jaw device, and a guide projection 25 which fits on the top of the second clamping member 2 when said second jaw device is in position thereon (FIG. 1). The back 24 of the second jaw device 22 is in juxtaposition with the second face 4 of the vise when said second jaw device is affixed thereto. The second jaw device 22 has a front 26, shown in detail in FIG. 2, and indicated in FIG. 1, spaced from the back 24 and formed in a plurality of stepped teeth 27, 28, 29, 30, 31 and 32 following a substantially semicylindrical pattern. In other words, the teeth 27 to 32 are formed in the inner surface of a semicylinder.

Figure 2:
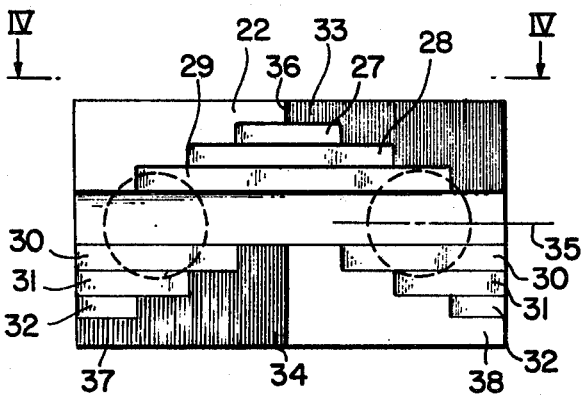
FIG. 2 is a view, taken along the lines II—II, of FIG. 1.
Figure 4:
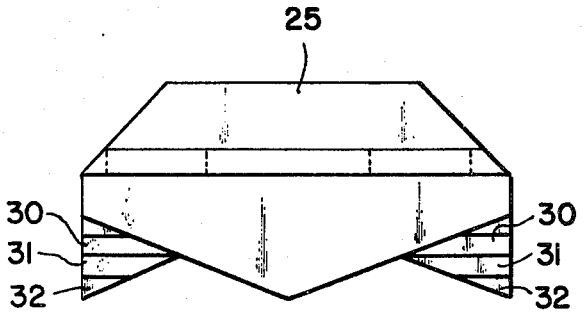
FIG. 4 is a view, taken long the lines IV—IV, of FIG. 2.

The front 26 of the second jaw device 22 is divided into first and second halves 33 and 34 by a central horizontal plane 35, as shown in FIG. 2. The teeth 27, 28, and 29 of the first half 33 of the second jaw device 22 are formed in the central part 26 thereof, as shown in FIG. 2, so that they interlock with the teeth 10, 11 and 12 of the first half 16 of the first jaw device 5, and the teeth 30, 31 and 32 of the second half 34 are formed in the end parts 37 and 38 thereof, as shown in FIGS. 2 and 4, so that they interlock with the teeth 13, 14 and 15 of the second half 17 of the first jaw device 5.

The first and second jaw devices 5 and 22 function to securely grip a pipe 39, or other object, between them, as shown in FIG. 1, without damage to said pipe.

While the invention has been described by means of a specific example and in a specific embodiment, I do not wish to be limited thereto, for obvious modifications will occur to those skilled in the art without departing from the spirit and scope of the invention.

I claim:

1. A pipe-gripping vise accessory for a vise having first and second clamping members mounted for movement toward and away from each other, the first and second clamping members of the vise having first and second faces, respectively, facing each other, said pipe-gripping vise accessory comprising a first jaw device having a fastening device for removably affixing it to the first face of the vise, said first jaw device having a back in juxtaposition with said first face when affixed thereto and a front spaced from the back and formed in a plurality of stepped teeth following a substantially semicylindrical pattern, the front of the first jaw device being divided into first and second halves by a central horizontal plane, the teeth of the first half being formed in the end parts thereof and the teeth of the second half being formed in the central part thereof; and a second jaw device having a fastening device for removably affixing it to the second face of the vise, said second jaw device having a back in juxtaposition with said second face when affixed thereto and a front spaced from the back and formed in a plurality of stepped teeth following a substantially semicylindrical pattern, the front of the second jaw device being divided into first and second halves by a central horizontal plane, the teeth of the first half being formed in the central part thereof so that they interlock with the teeth of the first half of the first jaw device and the teeth of the second half being formed in the end parts thereof so that they interlock with the teeth of the second half of said first jaw device.

* * * * *